US005159976A

United States Patent [19]

Virtue

[11] Patent Number: 5,159,976

[45] Date of Patent: Nov. 3, 1992

[54] HEAT TRANSFER DEVICE

[75] Inventor: Michael D. Virtue, Henderson, Ky.

[73] Assignee: Indiana Tube Corporation, Evansville, Ind.

[21] Appl. No.: 702,328

[22] Filed: May 20, 1991

[51] Int. Cl.[5] ..... F28F 9/26

[52] U.S. Cl. ..... 165/144; 165/156; 165/183

[58] Field of Search ..... 165/144, 156, 163, 183

[56] References Cited

U.S. PATENT DOCUMENTS

| | | | |
|---|---|---|---|
| 2,559,272 | 7/1951 | Beck | 165/183 X |
| 2,693,346 | 11/1954 | Petersen | 165/163 X |
| 2,963,779 | 12/1960 | Mosgard-Jensen | 165/183 X |
| 3,058,722 | 10/1962 | Rich | 165/156 |
| 3,692,104 | 9/1972 | Gerstmann | 165/163 |
| 4,175,617 | 11/1979 | Hahn et al. | 165/122 |
| 4,226,279 | 10/1980 | Eisinger et al. | 165/1 |

FOREIGN PATENT DOCUMENTS

| | | | |
|---|---|---|---|
| 658767 | 10/1951 | United Kingdom | 165/183 |

*Primary Examiner*—Allen J. Flanigan
*Attorney, Agent, or Firm*—Larson & Taylor

[57] ABSTRACT

A heat transfer device is provided which has an improved energy efficiency, utilizes significantly less space and costs less than conventional condensers in refrigeration units. The heat transfer device comprises a plurality of coil units disposed in a serpentine configuration and which are juxtapositioned to decrease space requirements and increase heat transfer. The coil units are constructed by fist attaching a lateral fin to a tube. The tube is then bent to form a continuous helical structure and this helical structure is then bent to form a plurality of parallel interconnected individual units disposed in a serpentine configuration. Multiple rows of interconnected parallel units are arranged to interfit so that the condenser occupies a minimum amount of space.

4 Claims, 4 Drawing Sheets

HEAT TRANSFER DEVICE

FIELD OF THE INVENTION

This invention relates generally to forced draft condensers and more specifically, to an energy efficient forced draft condenser utilizing a series of helical tube coils with the tube having a lateral fin thereon.

BACKGROUND OF THE INVENTION

In today's energy conscious environment, great effort is being made to increase the energy efficiency of heat transfer devices. In order to meet future increased efficiency demands for refrigerators, it is important to look at every aspect of the packaged unit that has an impact on the overall efficiency. Generally, efficiency increases can cost more money per unit, take up more space and/or be limited by physical or thermodynamic limitations.

In general, fins are used to increase the heat transfer capacity or to maintain a heat transfer capacity while reducing the other requirements, such as space, temperature differential, and conductive heat transfer media. There are many design tradeoffs that go into determining an optimal solution. Examples of such tradeoffs are type of material used, the space available, air flow rate, and the expense of material used.

The controlling formula for fin design, as far as thermal performance is concerned, is:

$$N_f = \frac{\tanh\sqrt{\frac{2h_cL_c^2}{Kt}}}{\sqrt{\frac{2h_cL_c^2}{Kt}}}$$

Where $h_c$=Convective Heat Transfer Coefficient
$L_c$=L+t/2
L=Length of Fin
t=Thickness
K=Thermal Conductivity of Fin Material The size and orientation of the fin with respect to the tube is also a factor to consider due to the limited amount of space in a typical forced draft condenser.

Another major difficulty is the attaching of two dissimilar metals. The attachment of two dissimilar metals can result in a corroding action from a bi-metal galvanic potential. The reaction and rate of corrosion depends on the two types of metal used and the conductive media they are immersed in.

A number of prior art references are directed towards increasing the efficiency of serpentine coil heat transfer devices. Systems designed to achieve these results are disclosed, for example, in U.S. Pat. Nos. 1,786,571 (Longsdale); 3,279,535 (Huet); 4,285,397 (Ostbo); and 4,580,623 (Smitte et al.).

The Longsdale patent discloses the use of a lateral fin on a tube for improving heat exchange. The fin is an integral part of the tube and thus avoids welding the fin to the tube.

The Huet patent discloses the use of a tube with a lateral fin attached to the exterior surface of the tube. The tube is bent in a serpentine arrangement for improved heat transfer. At each bend, triangular shaped cuttings are removed from the fins.

The Ostbo patent discloses the use of a tube with lateral fins. The tubes are positioned so as to allow the fins to form a plate-like structure between the tubes.

The Smitte et. al. patent discloses the use of tubes with lateral fins in a serpentine arrangement. Sets of tubes are staggered so as to increase the number of tubes. The fins are positioned so as to allow contact between the two tubes.

Other prior art references which disclose tubes with lateral fins in various configurations include U.S. Pat. Nos. 2,434,519 (Raskin); 2,646,972 (Schmid); 4,399,660 (Vogler et al.); and 4,966,230 (Houghes et al.).

Although all of the above-discussed devices relate to serpentine coil heat transfer devices with lateral fins, the prior art structures do not effectively solve the space and cost problems associated with refrigeration devices.

SUMMARY OF THE INVENTION

According to the invention, a heat transfer device is provided which has an improved energy efficiency utilizing the same space as prior art condensers or utilizes significantly less space than conventional condensers in refrigeration units while maintaining the same degree of energy efficiency. The heat transfer device comprises a plurality of base units or serpentine coils that are juxtapositioned to decrease space requirements and increase heat transfer. The heat transfer device is constructed by first attaching a lateral fin to a tube with a diameter D. The tube is then bent to form a continuous helical structure with the fin located on the interior surface of the helix. There is an air gap between each successive coil in the helical structure and this gap has width D/2. A desired length is selected for each unit of the condenser. The elongated single tube coil is then divided into a plurality of individual interconnected units of the desired length by forming the tube portions extending between units so that adjacent units lie in parallel spaced alignment to form a serpentine configuration.

The condenser so formed may be used in a refrigerator and provides a significant improvement in the energy efficiency of the refrigerator. The device improves the heat transfer per linear foot of tubing used. This has the advantage of reducing the amount of tubing used in a conventional condenser.

The efficiency gained provides the refrigerator manufacturer a more efficient condenser or an equally efficient condenser requiring less space. The steps utilized in the manufacture of the condenser presently disclosed will reduce the price of the finished condenser significantly over conventional condensers.

Other features and advantages of the invention will be set forth in, or apparent from, the following detailed description of the preferred embodiment of the invention.

DESCRIPTION OF THE PREFERRED EMBODIMENTS

Figure 1:
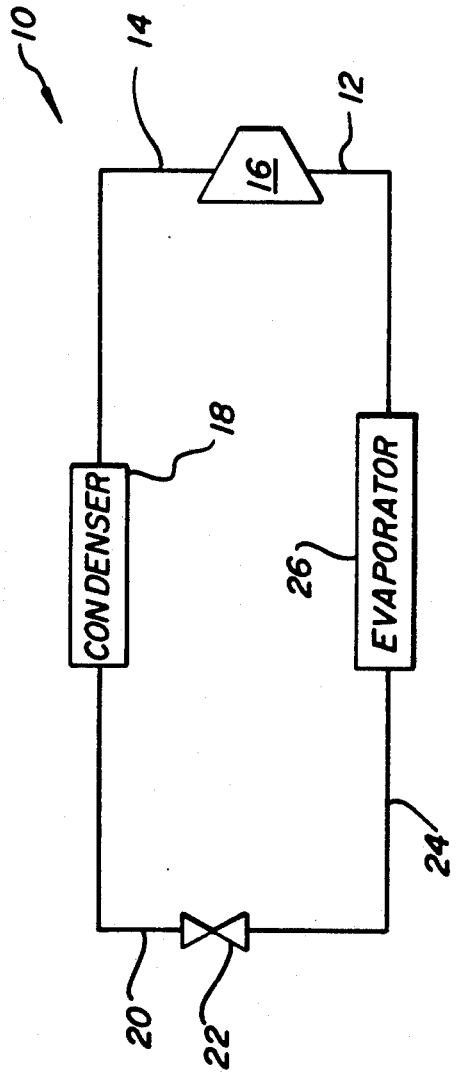
FIG. 1 is a block diagram of a typical refrigeration cycle.

Referring to FIG. 1, a typical refrigeration cycle is shown. The refrigeration cycle 10 in a domestic refrigerator, as in most refrigeration processes, is called the "Vapor-Compression Refrigeration Cycle" or V-C Cycle. The V-C cycle operates on the ideal principle of a heat engine transferring from one heat source to another. A typical refrigeration equipment block diagram is given in FIG. 1, for an ideal cycle.

Low pressure freon vapor in tube 12 is compressed to a hot, high pressure vapor in tube 14 by a compressor 16. Heat is taken out at a condenser 18 at a constant pressure until the freon becomes a saturated liquid in tube 20. The saturated liquid is then expanded by an expansion valve or capillary tube 22 to generate a low pressure, cold mixture of liquid and vapor in tube 24. This mixture is then transferred to an evaporator 26 where heat is absorbed until the freon has completely changed to a low pressure vapor, as in tube 12, and thus completes a cycle. In an actual refrigerator the cycle is not ideal. Some heat is generated in the freon from friction during compression stage. Most refrigerators cool the freon liquid in the condenser 18 below the saturation temperature. Also liquid freon vapor is usually heated to room temperature after the evaporator 26 to eliminate condensation on the tubing going to the compressor. The present invention is directed to providing a condenser unit having an improved efficiency.

Figure 2:
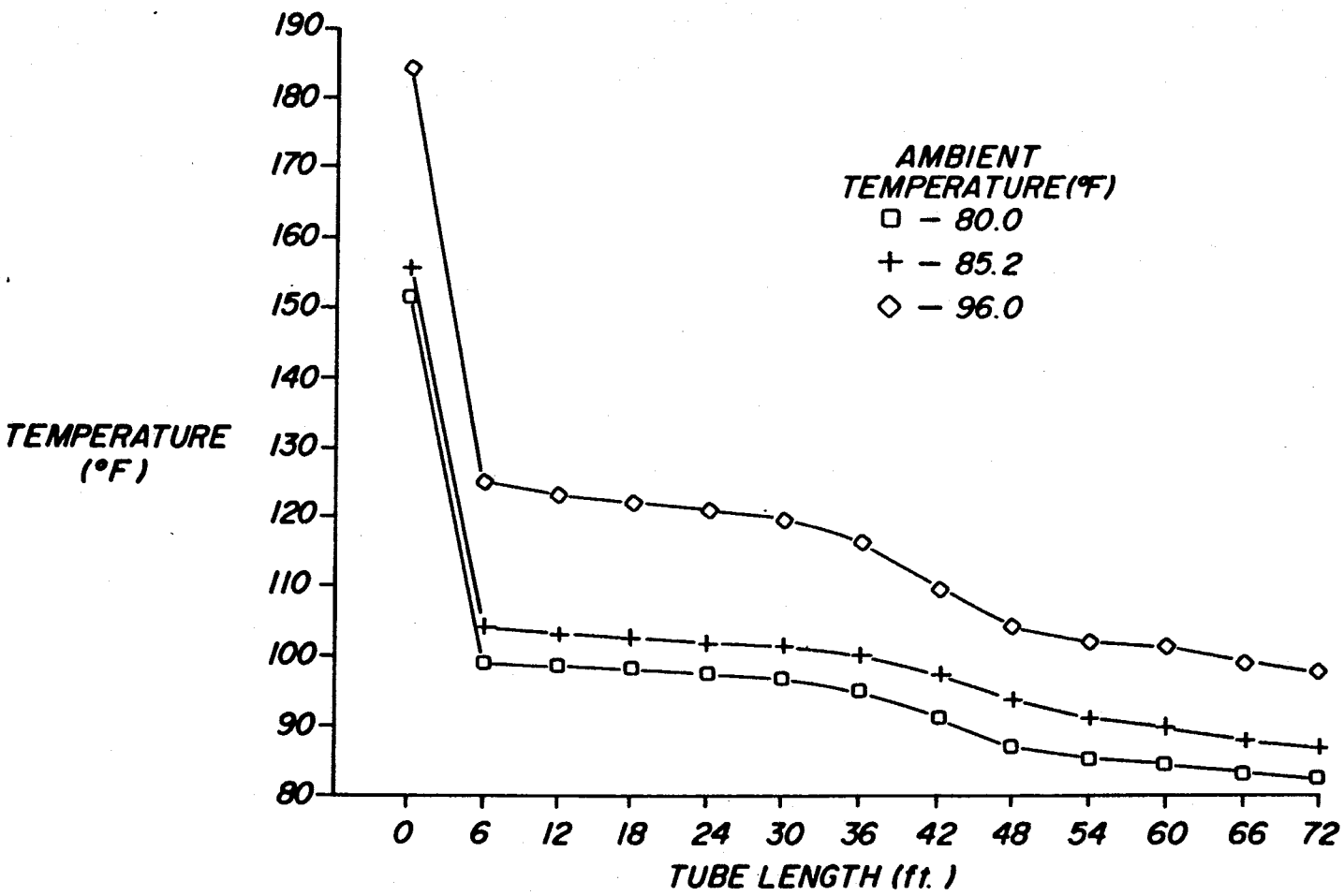
FIG. 2 is a graph of tube surface temperature vs tube length in a typical prior art condenser.

FIG. 2 is a graph of the temperature along the length of the condenser tubing of a conventional condenser. As may be seen in FIG. 2, the hot vapor gives up heat and drops the ambient temperature very rapidly during the initial 6 feet of tubing, i.e. until some gas begins to change phase into a liquid. For the next 25 to 30 feet, more and more liquid forms but due to the large quantity of gas bubbles present, heat transfer is slowed. At about 36 to 42 feet in the condenser 18, the freon is completely in a liquid state. The heat transfer rate increases and the temperature drops more rapidly. But as the freon temperature drops so does the difference between the freon and ambient temperatures. This causes the heat transfer rate to again slow down as the freon approaches the ambient temperature. An immediate goal of an energy efficient condenser is to duplicate the performance characteristics shown by the graph of freon temperature changes in the prior art devices, as depicted in FIG. 2, while also decreasing the size of the unit.

Figure 3:
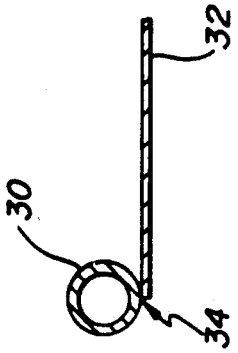
FIG. 3 is a cross sectional view of a tube having a fin thereon constructed in accordance with the invention.

FIGS. 3 through 7 depict a serpentine coil condenser constructed in accordance with the present invention. Referring to FIG. 3, a cross sectional view of a serpentine tube 30 with a lateral fin 32 attached thereto at 34 is depicted. The size and orientation of the fin 32 with respect to the tube 30 is an important factor. Because of the limited space available for a normal forced draft condenser the fin 32 has a minimum width which in the disclosed embodiment is 0.75 inch. A wider fin would space the tubes too far apart to place an equivalent amount of tubing in the space permitted for a conventional condenser. In a preferred embodiment, the fin 32 thickness is 0.023". It is important to maintain contact of fin 32 against tube 30 so that a solid weld 34 may be formed. The material used to form the tube 30 and fin 32 is selected to meet specific design parameters. Generally the material is selected from metals or alloys such as aluminum, copper or steel.

Figure 4:
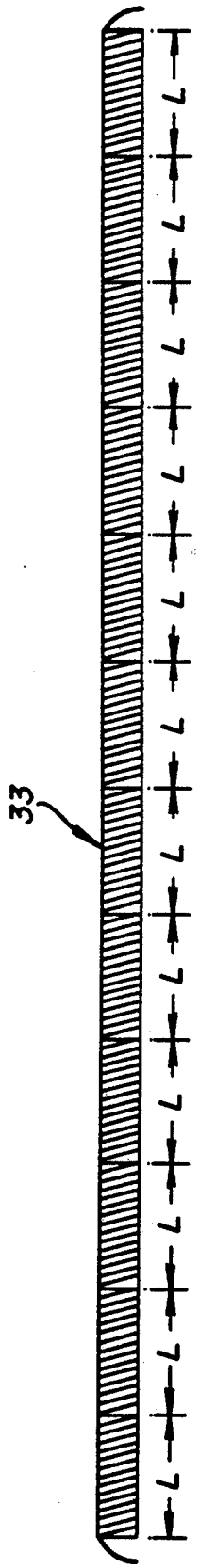
FIG. 4 is a view of the continuous helically coiled fin an tube structure prior to bending the tube structure into serpentine configuration.
Figure 5:
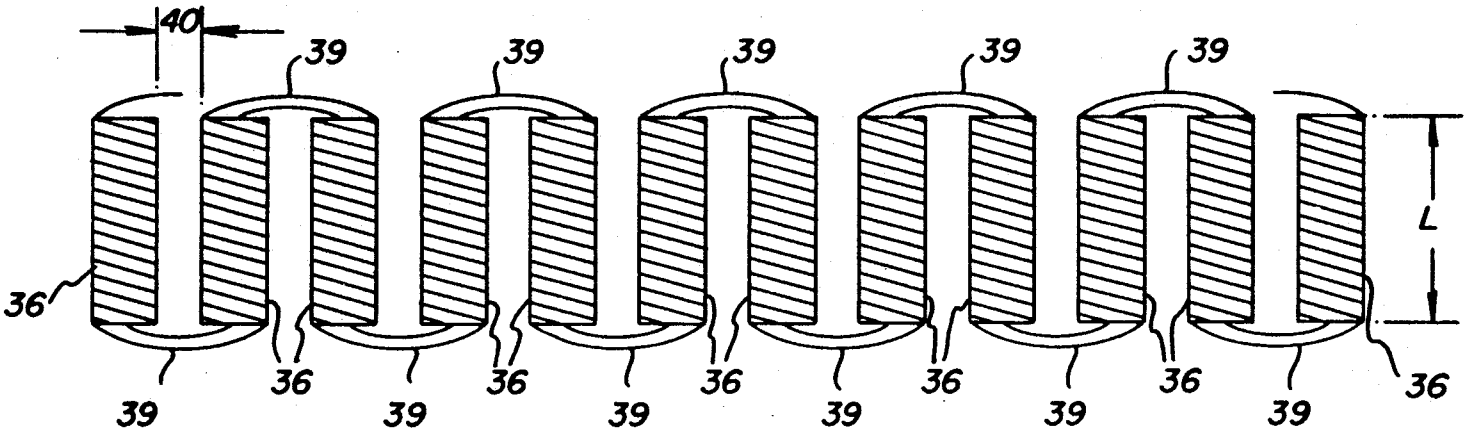
FIG. 5 is a view of the tube structure shown in FIG. 4 bent into a serpentine configuration.
Figure 7:
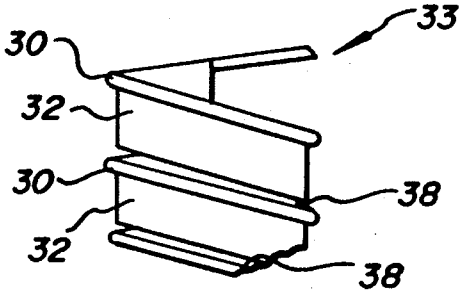
FIG. 7 is an exploded view of a portion of the coil structure.
Figure 6:
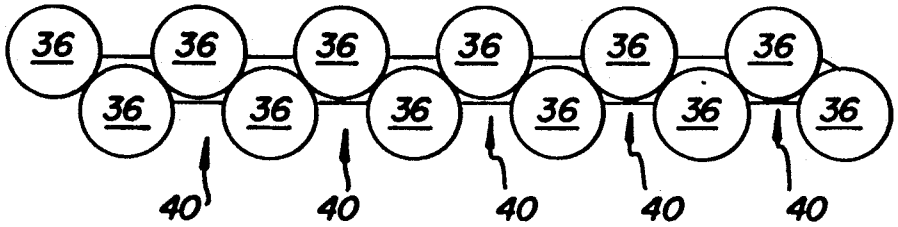
FIG. 6 is an end view of the coils depicted in FIG. 5 arranged to form a two layer configuration.

After the fin 32 has been welded to tube 30, the tube 30 is then wrapped helically to form a continuous helical structure 33 as shown in FIG. 4. FIG. 7 is an exploded view of one section of the helical structure 33. The tube 30 is bent so as to have the fin 32 on the inside of the helical structure 33. There is an air gap 38 between the outer surface of the fin 32 and the adjacent tube 30. This air gap allows for the air flow between the outer surface and inner surface of the helical structure 33. In a preferred embodiment, the air gap 38 is ½ of the diameter of tube 30. In a preferred embodiment, helical structure 33 has a diameter of approximately 2". The helical structure 33 is then formed into a series of helical coil units 36 as shown in FIG. 5. A desired length (L) for each helical coil unit 36 is selected and the tube portions 39 (FIG. 5) interconnecting adjacent helical coil units 36 are bent so that the units 36 are aligned in parallel as shown in FIG. 5 and form a serpentine passageway from one end of tube 30 through interconnected units 36 to the other end of tube 30. Multiple rows of interconnected helical coil units are formed as shown in FIG. 6. It is important to position the second row so as to have the helical coils 36 aligned with the gaps 40 formed between the first row of helical coils 36. By placing alternating rows in the gaps of the adjacent row, a denser structure is established and thus, considerably more feet of tubing 30 may be placed in a limited amount of space. By following the above construction technique, any number of helical coils 36 may be placed in a row and any number of rows may be installed, as space permits.

Figure 8:
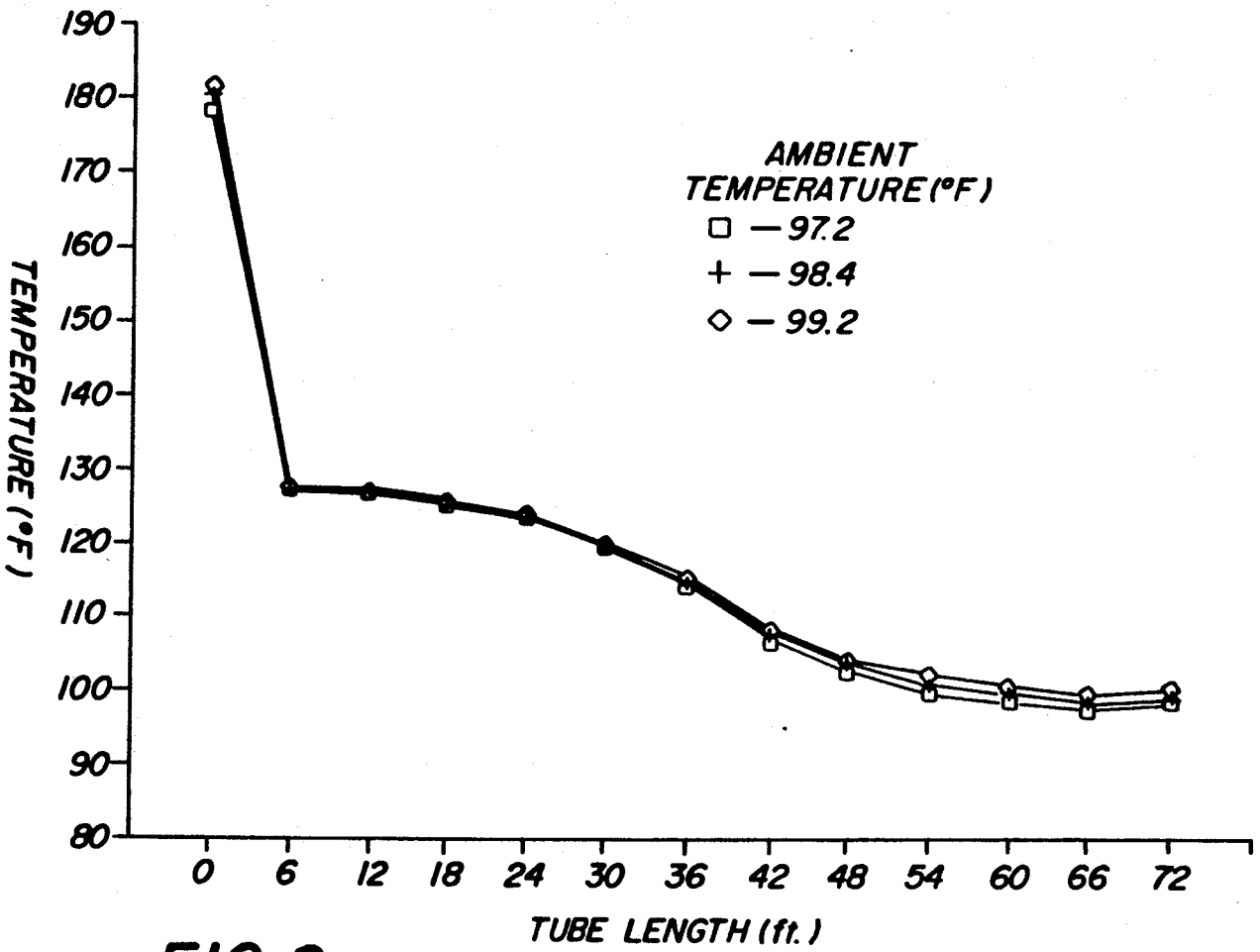
FIG. 8 is a graph of tube surface temperature vs tube length in a condenser constructed in accordance with the invention.

Considering the overall objective of the serpentine heat transfer device, the same characteristics of a conventional refrigerator condenser is duplicated by substituting a serpentine coil as described above while also saving space and increasing compatibility. As may be seen by FIG. 8, the temperature characteristics of freon in the above described serpentine coil are very similar to that of a conventional refrigeration unit. There is a gain in energy efficiency due to the increased surface area along with the arrangement of air gaps 38 and 40 and the juxtapositioning of layers of helical structures as described above.

Although the present invention has been described to specific exemplary embodiments thereof, it will be understood by those skilled in the art that variations and modifications can be effected in these exemplary embodiments without departing from the scope and spirit of the invention.

What is claimed is:

1. A heat transfer device comprising, in combination, a plurality of rows of interconnected helical coils, each of said rows of interconnected helical coils comprising a plurality of spaced interconnected helical coils to form gaps between adjacent helical coils, each row of helical coils having the helical coils thereof disposed in the gaps formed between the helical coils in adjacent rows to form a compact heat transfer device, each of said helical coils being formed by a continuous tube with substantial spacing between each coil turn, a fin attached to the continuous tube and extending from each coil turn in the tube towards an adjacent coil turn to provide an air space between adjacent coils.

2. A heat transfer device according to claim 1 wherein said air space is approximately equal to the radius of said tube.

3. A heat transfer device wherein the fin has a width of approximately three quarters of an inch.

4. A heat transfer device wherein the helical coil has a diameter of approximately two inches.

* * * * *